US006227531B1

(12) United States Patent
Guerrero et al.

(10) Patent No.: US 6,227,531 B1
(45) Date of Patent: May 8, 2001

(54) JOB SEPARATION PROCESS, SYSTEM AND METHOD FOR DISTRIBUTING PRINT JOBS

(75) Inventors: Marco A. Guerrero; Israel Cruz; Roberto Obregon, all of Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/320,133

(22) Filed: May 25, 1999

(51) Int. Cl.[7] ..... B65H 33/04

(52) U.S. Cl. ..... 270/58.31; 270/1.01; 399/382; 399/404

(58) Field of Search ..... 270/58.31, 58.32, 270/58.03, 58.05, 1.01; 271/9.05, 9.06, 9.11, 9.13; 399/382, 404

(56) References Cited

U.S. PATENT DOCUMENTS

| | | | | |
|---|---|---|---|---|
| 3,873,083 | | 3/1975 | Fujimoto | 271/64 |
| 4,188,025 | | 2/1980 | Gusfafson et al. | 271/314 |
| 4,352,012 | | 9/1982 | Verderber et al. | 235/487 |
| 4,480,825 | | 11/1984 | Landa | 271/81 |
| 4,712,786 | | 12/1987 | Looney | 271/207 |
| 4,977,432 | * | 12/1990 | Coombs et al. | 399/404 |
| 4,989,191 | | 1/1991 | Kuo | 369/33 |
| 5,007,625 | | 4/1991 | Kremers et al. | 270/53 |
| 5,012,932 | | 5/1991 | Omura et al. | 209/534 |
| 5,156,384 | * | 10/1992 | Donahue | 270/58.31 |
| 5,316,279 | * | 5/1994 | Corona et al. | 270/58.31 |
| 5,513,013 | | 4/1996 | Kuo | 358/448 |
| 5,709,374 | * | 1/1998 | Taylor et al. | 270/58.32 |
| 5,741,009 | | 4/1998 | Kawano et al. | 271/182 |
| 5,790,915 | | 8/1998 | Arcaro et al. | 399/2 |
| 5,848,346 | * | 12/1998 | Takashiro | 270/58.31 |
| 5,897,250 | * | 4/1999 | Hirai et al. | 399/404 |
| 6,089,559 | * | 7/2000 | Steinhilber | 270/58.31 |

* cited by examiner

*Primary Examiner*—H. Grant Skaggs

(57) ABSTRACT

A method is provided for identifying individual output jobs from an output stack, each output job including a stack of one or more individual sheets. The method includes the steps of: providing a sheet handling device having a sheet delivery device and an output tray, the sheet delivery device operative to move individual sheets from the sheet handling device to the output tray; delivering an output job with the sheet delivery device to the output tray; and delivering a job separation page with the sheet delivery device to the output tray, the job separation page stacked adjacent the output job such that an offset portion of the job separation page extends outwardly of an adjacent edge of the output job; wherein the job separation page is operative to identify one end of the adjacent output job.

20 Claims, 6 Drawing Sheets

JOB SEPARATION PROCESS, SYSTEM AND METHOD FOR DISTRIBUTING PRINT JOBS

FIELD OF THE INVENTION

This invention relates to document delivery devices, and more particularly, to job separation and identification capabilities on printers and document delivery devices having job offset delivery features and/or distinct media input features for distributing print jobs at an output location.

BACKGROUND OF THE INVENTION

A number of document handling devices are known in the art for sorting and stacking documents, paper and/or printable media. One document handling device comprises a printer, such as a laser or an inkjet printer. Another document handling device comprises a copy machine. Yet another document handling device comprises a facsimile machine. Even another document handling device comprises a document scanning device. With each of these devices, stacks of documents are processed by the device to generate output jobs such as print jobs or facsimile output jobs. To aid in identifying individual output jobs, a number of techniques have been employed when delivering individual jobs to an output tray of a document handling device.

Several techniques have been employed to identify individual jobs when they are deposited in an output tray of a document handling device. For example, it has long been known to generate special header sheets at the beginning of each new print job of a printer or a copy machine. In the past, a header sheet has been formed from a piece of paper sized identically to the pages of the output job. The header sheet typically has hash marks extending around the outer border so as to visually identify the sheet as a header sheet, and contains additional identifying information such as a user identification or a job identification number. However, it is oftentimes difficult to identify a header sheet from within a stack of print jobs as they are formed from identically sized pieces of paper.

Another technique for identifying jobs within an output tray of a document handling device entails stacking together the sheets of paper forming a job in offset positions, such that each job is offset from neighboring jobs. For example, it is known to sort sheets of paper on a tray such that individual jobs are offset by either repositioning the output or discharge rollers during paper delivery/output so as to deliver successive print jobs that are offset from adjacent print jobs. Optionally, it is known to laterally reposition an output tray between neighboring print jobs such that adjacent print jobs will be offset from one another. Exemplary details of such offset stacking arrangements are shown below in greater detail with reference to FIG. 4. One problem associated with the offset stacking of print jobs is encountered by users who are unfamiliar with such offset stacking. It is relatively easy and common for a user to retrieve a plurality of adjacent, offset print jobs from an output tray, then collect the jobs together by edgewise inverting the stack of jobs in a vertical configuration, and dropping the stack of loosely held jobs onto the edge of a tabletop so as to align all the jobs into a single, neat pile. The above typically occurs because a user is simply unaware that the stack of offset print job has been generated in this manner so as to separate individual jobs to facilitate retrieval of individual jobs from an output stack. Such frequent occurrence has led many copier manufacturers and printer manufacturers to eliminate offset delivery features from their devices. To many users, it is relatively unclear that such offset delivery is intended to separate print jobs. In the case of many users, the user merely feels that they are re-stacking a poorly stacked collection of print jobs. Therefore, there is a need to provide an improved way for identifying job separation and for implementing a job separation process.

Another technique that allows a limited amount of identification between jobs delivered to an output tray on a document handling device is provided by devices that have more than one input source for delivering paper to the device. For example, most printers have at least two standard input sources, such as a multipurpose tray and a standard-sized tray. One tray can be configured to provide 8½×11 inch paper, and another tray can be configured to provide A4 paper or legal-sized paper. Accordingly, a printer is able to print on different paper sizes such as letter-sized, legal-sized, ledger-sized, A4-sized, etc. It is also very common to provide at least two output trays for receiving jobs, or media, which have been processed by the printer. For example, print jobs comprising printed media can be delivered either to a face-up tray that is provided at the rearmost end of many printers, or to a face-down tray that is most often located at the top of a printer. A limited capability for distinguishing individual print jobs can be provided by printing adjacent print jobs on different sized paper. However, it is unlikely that adjacent print jobs will require different sized paper. Additionally, it is inconvenient and undesirable to print successive print jobs on different sized paper when most users require the use of a standard sized, or commonly sized, paper when printing a job.

SUMMARY OF THE INVENTION

From the foregoing, it can be appreciated that a user's experience with a document handling device may be enhanced by providing a mechanism that enables quick and clear identification of individual print jobs within an output tray of a document handling device. Accordingly, a method is provided for distributing output jobs from a document handling device such that a user can quickly and easily identify individual output jobs when retrieving the jobs from an output tray.

According to one aspect of the invention, a method is provided for identifying individual output jobs from an output stack, each output job including a stack of one or more individual sheets, comprising: providing a sheet handling device having a sheet delivery device and an output tray, the sheet delivery device operative to move individual sheets from the sheet handling device to the output tray; delivering an output job with the sheet delivery device to the output tray; and delivering a job separation page with the sheet delivery device to the output tray, the job separation page stacked adjacent the output job such that an offset portion of the job separation page extends outwardly of an adjacent edge of the output job; wherein the job separation page is operative to identify one end of the adjacent output job.

According to another aspect of the invention, a method of separating print jobs comprises: providing a printer having an output tray configured to receive a stack of completed print jobs; delivering a first print job to the output tray; delivering a print job separation page atop the first print job such that at least one edge of the first print job is visibly offset from the first print job; and delivering a second print job atop the print job separation page such that the one edge of the print job separation page remains visibly offset from the first print job and the second print job so as to visibly separate the first and second print jobs.

According to yet another aspect of the invention, a method of separating output jobs comprises: providing a document handling device having an output tray configured to receive a stack of output jobs, a first input tray containing a stack of first-sized paper, and a second input tray containing a stack of second-sized paper, the second-sized paper having a planar dimension sized larger than a corresponding dimension of the first-sized paper as stacked in the output tray; generating a print job with the first-sized paper; delivering the generated print job to the output tray; generating a job separation page with the second-sized paper; and stacking the generated job separation page atop the delivered print job such that the large planar dimension of the job separation page indicates one end of the print job.

One advantage of the invention is quick and easy job identification by a user, such as identification of output jobs or print jobs from printers, facsimile machines, copiers, scanners or multi-function peripheral (MFP) devices. Another advantage is provided by visual/tactile indicia that enhance identification of particular output jobs present within a stack of such output jobs. Even a further advantage is provided by enabling quick, visual and/or tactile identification of individual output jobs from within a stack of jobs, even where output job offset features are not enabled by the document handling device.

DESCRIPTION OF THE DRAWINGS

Preferred embodiments of the invention are described below with reference to the following accompanying drawings depicting examples embodying the best mode for practicing the invention.

DETAILED DESCRIPTION OF THE INVENTION

This disclosure of the invention is submitted in furtherance of the constitutional purposes of the U.S. Patent Laws "to promote the progress of science and useful arts". U.S. Constitution, Article 1, Section 8.

A method is provided that enables job separation/identification capabilities on any document handling device having the ability to offset output jobs and/or having the capability to receive multiple sizes of documents at one or more input trays for delivery to one or more common output trays. In this detailed description, one embodiment of a document handling device comprises a color laser printer which includes a job output offset mechanism capable of offsetting print jobs, and multiple input trays associated with a sheet advancement mechanism that enables selective utilization of a mixture of paper sizes when delivering print jobs to an output tray. It should be understood that this is for the purpose of illustration and is not provided as a limitation in that the present invention may be practiced on other document handling devices where it is desirable to provide job separation capabilities that are more easily identified by a user and enable enhanced recognition of individual output jobs, such as print jobs from a printer.

Throughout this detailed description, numerous specific details are set forth such as particular printer control systems, printing systems and media delivery systems used to deliver, sort and print graphical/textual material onto print media comprising sheets of paper, in order to provide a thorough understanding of the present invention. It will be appreciated by one having ordinary skill in the art that the present invention may be practiced without certain of such specific details. In other instances, well-known components, structures and techniques have not been described in detail in order to avoid obscuring the subject matter of the present invention.

Figure 1:
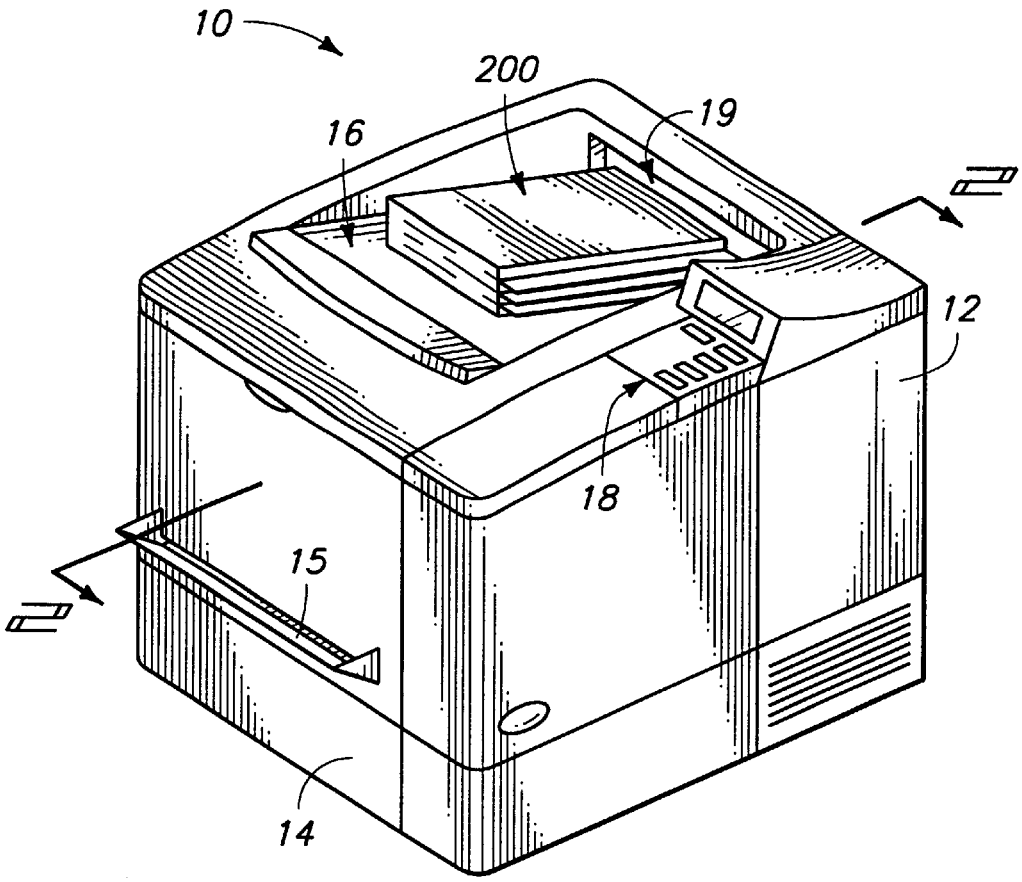
FIG. 1 is a perspective view of a document handling device in the form of a printing system and in accordance with one embodiment of Applicant's invention.

Referring now to FIG. 1, a document handling device which may incorporate the present invention is illustrated. The document handling device of FIG. 1 is illustrated so as to highlight the job separation features of Applicant's invention. Accordingly, a document, or sheet, handling device is shown illustrated by reference numeral 10 as identifying a color laser printer 10 according to one implementation of Applicant's invention. Color laser printer 10 is usable for printing color images onto a sheet or page of print media. Typically, color laser printer 10 comprises a printing system that is connected for control with a microprocessor-based computer (not shown). Printing system 10 is shown as a electrophotographic printer that is configured to print monochrome and/or color images onto sheets of paper. As shown in FIG. 1, color laser printer 10 includes a housing 12, paper trays 14 and 15, output tray 16, and user interface 18. User interface 18 includes one or more of a keyboard, display or keypad that enables a user to operate and/or configure printer 10. A stack 200 of individual print jobs is shown delivered to output tray 16 from an output slot 19.

Figure 2:
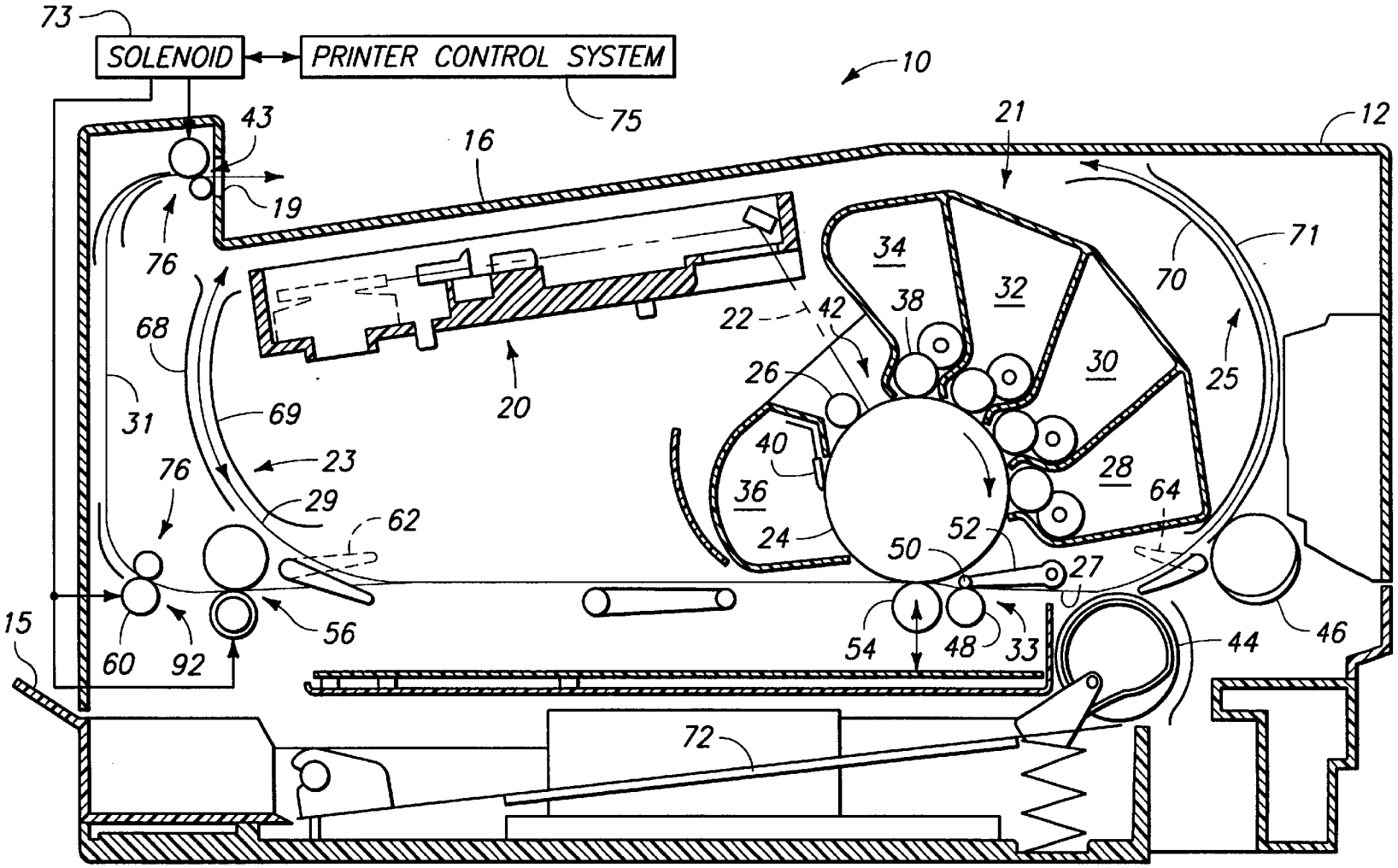
FIG. 2 is a vertical sectional view of the printing system of FIG. 1 taken along line 2—2.

As shown in FIGS. 1 and 2, color laser printer 10 is configured to generate four different colored image planes. Printer 10 comprises a shuttle type paper drive color laser printer that is shown in greater detail in vertical sectional view with respect to FIG. 2. The construction of such a laser printer is understood in the art, and is described in greater detail with reference to Applicant's U.S. patent application Ser. No. 09/238,969 now U.S. Pat. No. 5,978,642, entitled "Color Printer With Shuttle Type Paper Drive and Method", naming David J. Arcaro and James G. Bearss as inventors, and filed on Jan. 27, 1999. This application Ser. No. 09/238,969 is herein incorporated by reference as evidencing the presently understood construction of a color laser printer. However, it is understood that any form of document handling device having a plurality of input trays and/or a system for delivering output jobs in a stack and in an offset manner, can be utilized to implement Applicant's invention.

As shown in FIG. 2, printer 10 includes a shuttle paper path 29 that extends between a forward track 23 and a reverse track 25. In operation, individual sheets of paper are delivered from one of trays 14 and 15 and deposited at a nip between a pair of spring-biased pressure rollers 50 and a single elongate grit-covered transfer roller 54. Print shaft 48 is rotatably actuated to deliver a single sheet of paper 27 into position between a photoconductor drum 24 and a transfer roller 54 where a first color image plane is printed onto paper 27 from drum 24. Accordingly, paper 27 is presented between rollers 50 and shaft 48, then pressed against drum 24, in order to deliver a first image onto paper 27. Paper 27 is then further delivered along forward guide track 23. After transfer of a first image onto paper 27, roller 54 is downwardly biased away from drum 24 while rollers 50 and shaft 48 are used to move paper 27 into a reverse guide track 25. Subsequently, additional color planes are deposited onto drum 24, then transferred onto sheet of paper 27 via the above technique. Shaft 48 and rollers 50 cooperate to provide a paper drive sheet feeder system which forms a sheet advancement mechanism 92 (see FIG. 3).

Also shown in FIG. 2, printer 10 includes a laser scanner 20 that generates an optical image via an imaging path, or slot, 22, which is superposed onto photoconductor drum 24 after drum 24 has been charged with a charge roller 26. Subsequently, one of four different color toners is delivered from one of toner supply reservoirs 28, 30, 32 and 34.

Print jobs are delivered to printer 10 from a microprocessor-based computer (not shown). Color images are printed onto sheet 27 in the form of individual image planes (e.g., including text and/or graphics). As used here, the term "image" is intended to include text, graphics, or both text and graphics, and any visually perceptible media.

As shown in FIG. 2, printer 10 comprises a color laser printer. According to one embodiment, printer 10 is formed from some internal components that are similar to those found in a LaserJet 5000 printer sold by Hewlett-Packard Company of Palo Alto, Calif. However, additional modifications have been incorporated in order to provide improved color printing, and to provide offset of print jobs when delivering such jobs to output tray 16.

Various techniques are known for color printing onto a single piece of paper via a laser printing system. Printer 10 includes a housing 12 which is configured to support internal operating components as shown in FIG. 2. Laser scanner 20 is supported in housing 12, and black, cyan, magenta and yellow toner is stored in reservoirs 28, 30, 32 and 34, respectively. Laser scanner 20 acts on drum 24 after charge roller 26 imparts charge to drum 24 upstream of where laser scanner 20 acts on drum 24. A developer roller 38 is provided in each of reservoirs 28–34 which acts against drum 24 downstream of where a laser scanner 20 acts on drum 24 while delivering toner there against. A transfer roller 54 cooperates with drum 24 to impart an image onto sheet 27, and a cleaning blade 40 cleans drum 24 within a waste toner reservoir 36 after an image has been imparted to sheet 27. Finally, a fuser 56, spaced-apart from and downstream of drum 24, fuses a final color image onto paper 27 while it is being ejected from printer 10. As shown in FIG. 2, a waste toner reservoir 36 is provided in cartridge 21 for collecting waste toner that is removed by cleaner blade 40 from drum 24, after an image has been deposited onto paper 27. An aperture, or slot, 42 is provided in cartridge 21 in which charge roller 26 is supported in contact with drum 24, and through which optical images are delivered via imaging path 22 onto charge drum 24.

It is understood that printer 10 works as a presently understood electrophotographic, or laser, printing process. Furthermore, it is understood that any of a number of different types of printing systems could be utilized such as an inkjet printer or a monochrome printer.

In order to impart the novelty of Applicant's invention, a plurality of paper trays 14 and 15 are provided on printer 10. Additionally, media delivery system 76 is provided with laterally adjustable features which enable the impartation of offset when depositing a divider sheet or offset banner page between adjacent print jobs.

As shown in FIG. 2, a shuttle type paper drive 33 is provided in printer 10 which includes grit shaft 48 and a pair of pressure rollers 50 that clamp paper 27 along left and right margins to impart precise registration and delivery of paper 27 therebetween while printing four separate color images onto paper 27. It is understood that shuttle type paper drive 33 forms part of a sheet advancement mechanism 92 (see FIG. 3). Additionally, drum 24, transfer roller 54, fuser 56, advancement rollers 60, and exit rollers 43 also cooperate to provide sheet advancement mechanism 92 (of FIG. 3). Advancement rollers 60 also cooperate to provide sheet advancement mechanism 92.

In operation, advancement rollers 60 and exit rollers 43 are carried together on a common carriage of document handling device 76 that is supported for movement to provide for lateral positioning of paper sheets that exit housing 12 so as to impart offset to print jobs being delivered from output slot 19. As will be described in greater detail below, rollers 43 and 60, and fuser 56 are carried on a carriage for movement via an offset shift drive solenoid 73. Such solenoid imparts movement in a direction perpendicular to the vertical sectional view taken through printer 10 to impart offset to sheets of paper delivered from output slot 19 and into output tray 16. In operation, a printer control system 75 activates offset shift drive solenoid 73 after a sheet of paper has been delivered between rollers 43 and 60, and fuser 56. Accordingly, such rollers 43 and 60 and paper 27 are moved laterally of a standard position so as to cause an offset delivery of paper 27 into tray 16. Accordingly, offset divider sheets of paper can be delivered between successive print jobs to enable a user to more readily identify individual print jobs.

In order to facilitate transfer of paper 27 during color printing operations within printer 10, a pair of paper redirection guides 62 and 64 are alternately actuated so as to cause a sheet of paper to move into guide tracks 23 and 25, respectively. Guide track 23 is formed by a pair of tracks 68 and 69, and guide track 25 is formed by a pair of tracks 70 and 71. Guide 61 is solenoid actuated, whereas guide 64 is spring-biased and activated by paper advancement at desired times so as to impart redirection of paper 27 while being transferred from tray 14. Guide 62 is upwardly biased when transferring paper 27 to fuser 56 and out output slot 19.

Additionally, a pick roller 44 guides delivery of individual sheets of paper between rollers 50 and grit shaft 48, as is understood in the art. A pressure plate 72 urges a stack of paper into engagement with pick roller 44 which delivers individual sheets there about to rollers 50 and shaft 48.

Figure 3:
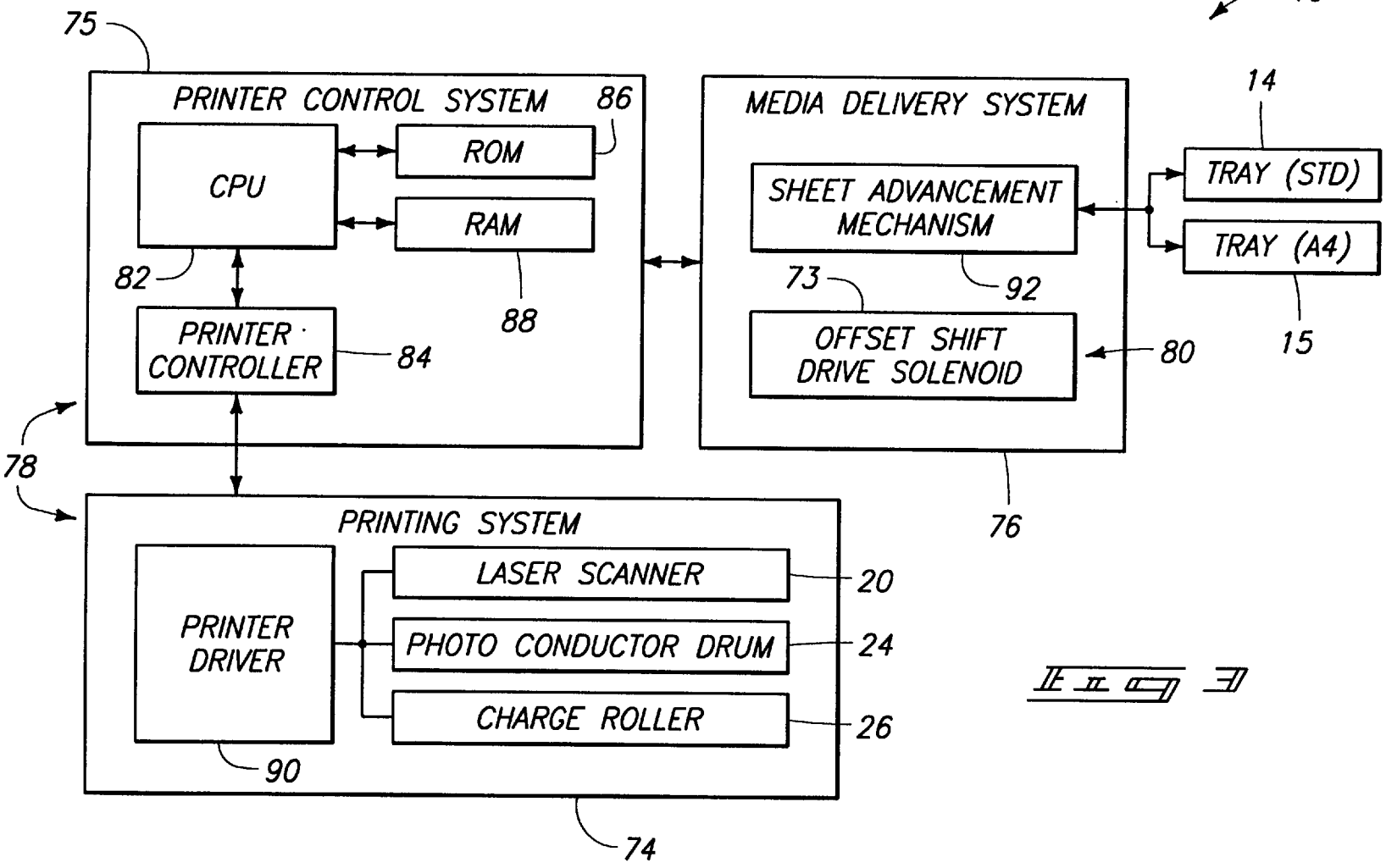
FIG. 3 is a block diagram of the printing system of FIGS. 1 and 2 using job separation process features that realize several embodiments of the invention depicted below with reference to FIGS. 5–9.

FIG. 3 illustrates in greater detail components of printer 10 that are responsible for enabling Applicant's job separation features as identified in FIGS. 5–9. More particularly, a print engine is provided by a printing system 74 and a printer control system 75. The print engine comprises all the components necessary to implement actual printing onto individual sheets of paper, such as sheets of paper comprising a print job. Additionally, a media delivery system, or sheet delivery device, 76 is provided in association with printer control system 75 for selectively delivering sheets of paper from "tray 14" and/or "tray 15".

As shown in FIG. 3, printer control system 75 includes a central processing unit, or CPU, 82 which is formed from processing circuitry. Additionally, printer control system 75 contains memory, including read only memory (ROM) 86 and random access memory (RAM) 88. Furthermore, printer control system 75 includes a printer controller 84 that is coupled in communication with CPU 82.

Media delivery system 76 of printer 10 includes a sheet advancement mechanism 92 and an offset shift drive solenoid 73. Sheet advancement mechanism 92 cooperates with tray 14 and tray 15 to selectively deliver paper therein into print engine 78 where printing system 74 places images onto individual sheets of paper. Media delivery system 76 delivers paper through printer 10 during a printing operation, with the printed paper being delivered into the output tray 16 (of FIG. 1). Offset shift drive solenoid 73 is selectively activated to impart a lateral offset, relative to a paper travel path direction, when delivering divider sheets between adjacent print jobs pursuant to the implementation of Applicant's invention.

Printing system 74 includes a printer driver comprising a software routine that converts an application program's printing request into a language that can be understood by a printer. Printer driver 90 cooperates with laser scanner 20, photoconductor drum 24, and charge roller 26 to generate and transfer individual image planes onto pieces of paper being delivered through printer 10 by media delivery system 76.

The ability to provide job separation capabilities on document handling devices such as printers is highly desirable. The ability to provide a useful and inexpensive technique for separating jobs will enhance recognition by users of such capabilities which will prevent some users from inadvertently collecting the stacks of print jobs and laterally stacking such jobs so as to collate them together into a single, common stack which no longer identifies individual print jobs. Printer 10, as described above with reference to FIGS. 1–3, teaches one document handling device having both job offset delivery capabilities and a dual input tray feature. Job offset delivery capabilities enable the delivery of single-sheet job separation pages comprising divider pages that are inserted between adjacent print jobs to identify such jobs. Additionally, or optionally, the job separation pages comprise banner pages having different sized, colored and/or indicia-marked single-page jobs that are inserted between adjacent print jobs in order to visually and/or tactilely identify such jobs.

Accordingly, implementation of Applicant's invention utilizes some of the equipment and processes that are already available in many prior art printers and document handling devices having multiple sources for inputting paper. Accordingly, any printer having the ability to offset jobs and/or deliver different types of media from different media trays could be substituted for printer 10 of FIGS. 1–3.

Figure 4:
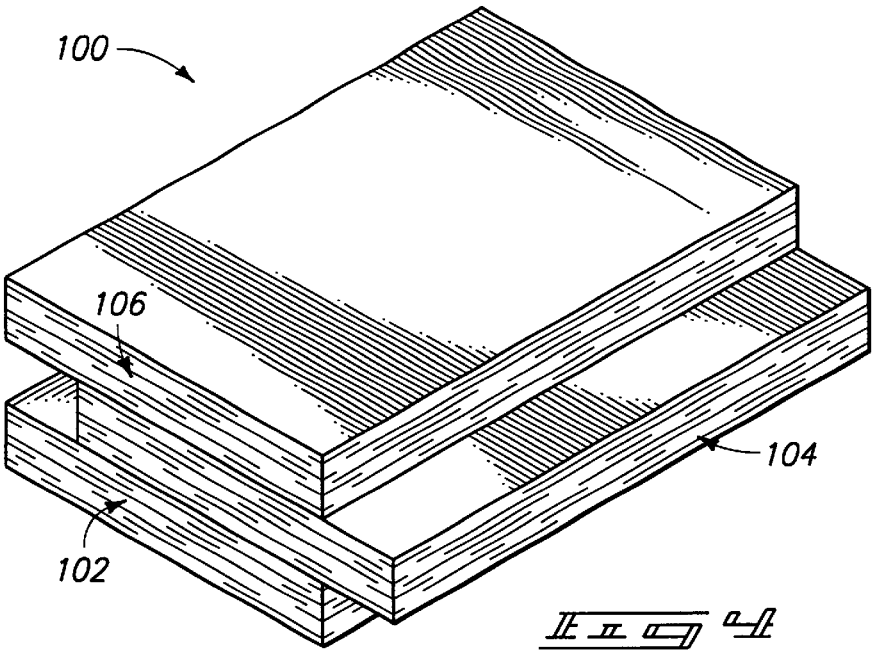
Fig 4 PRIOR ART
FIG. 4 is a simplified perspective view of a prior art stack of output jobs generated by job offset features.

FIG. 4 illustrates one prior art feature that is presently known in the art and can be implemented with many printers, including printer 10 depicted in FIGS. 1–3. Accordingly, FIG. 4 illustrates an offset print job capability which allows a printer to separate adjacent jobs from one another so that a user can quickly identify distinct print jobs as they are delivered into an output tray.

As shown in FIG. 4, the term "offset" means that the page of the complete print job is delivered shifted to one side of the target output tray by sliding the delivery system, i.e., the rollers, gears, etc., from their original or standard position at a center location. Such delivery systems are well known in the art. The offset distance may vary depending on the device, ranging from a few millimeters up to an inch or more. A series of typical print jobs would form a paper stack 100, as shown in FIG. 4.

As shown in FIG. 4, stack 100 comprises individual print jobs 102, 104 and 106. Print job 104 is offset with respect to print jobs 102 and 106 such that adjacent print jobs 102, 104 and 106 are offset with respect to neighboring print jobs.

In addition to the already-mentioned problem of users inadvertently "re-stacking" a stack of print jobs that have been retrieved from within a stack in an output tray, another problem is encountered when job offset is used to separate jobs where different paper, or media, sizes may be delivered to the same output tray. Modern document handling devices, such as modern printers and print engines, have the capability of delivering a large number of different sized paper or media to the same output tray, which results in a mixture of paper sizes being delivered to the same delivery or output tray. For example, for the case where A5 paper is being delivered to one tray and a following job is printed on standard letter size paper, even where an offset feature is used, it is nearly impossible to clearly distinguish the adjacent print jobs. If the quality of the stack is not very accurate, it will be very hard to notice the offset pages in the adjacent print jobs since the sizes are so close together.

Figure 5:
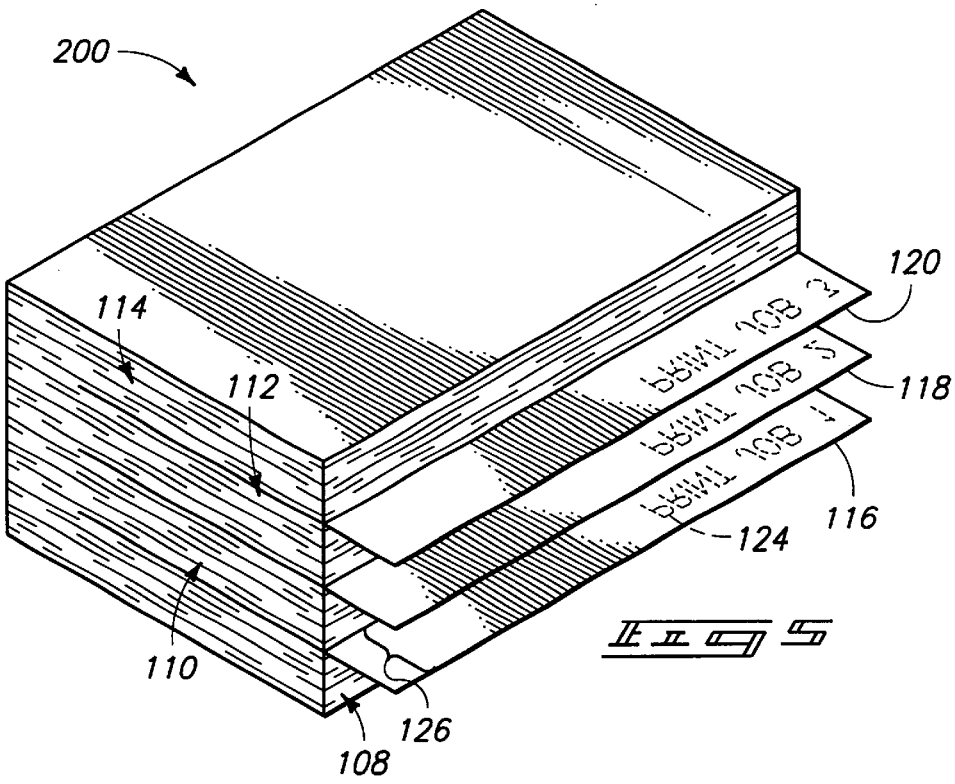
FIG. 5 is a perspective view of a stack of output jobs generated with a single-page offset banner page interposed between adjacent output jobs and containing identifying indicia printed on an exposed edge of the banner page.

FIG. 5 illustrates a media or print stack 200 realized via implementation of Applicant's technique for distributing print jobs in an output tray of the document handling device described above with reference to FIGS. 1–3. A relatively simple technique for separating jobs, such as print jobs and output jobs, is realized by using an offset feature in combination with features that are already found standard on most output devices such as printers. Stack 200 is formed by outputting a series of individual print jobs 108, 110, 112 and 114, with each print job being delivered to an output tray at a standard position. Hence, none of print jobs 108–114 are delivered at an offset position. Individual print jobs are separated by single-sheet job separation pages 116, 118 and 120. Each job separation, or divider, page 116–120 comprises a single-page output job that contains at least one edge that protrudes out from print jobs 108–114 and has text to identify a neighboring print job. The protruding portion of job separation pages 116–120 comprises an offset portion, or projection, 126 that demarcates the boundary between adjacent print jobs (here, job separation page 116 separates print jobs 108 and 110). Although it is not necessary, the one-page output job can include graphical material, such as printed text and/or graphics or special coloring which will act like a banner that visually identifies one of the adjacent print jobs. Hence, job separation pages 116–120 each form a banner page. For example, job owner information and/or print job information can be directly printed onto offset portion, or banner, 126 where it is visible to a user retrieving such stack 200 from a document handling device. Optionally, job separation pages 116–120 can be formed from single (or multiple) sheets of paper which are devoid of any printing.

Accordingly, individual job separation, or banner pages, 116–120, according to the implementation depicted in FIG. 5, are delivered with a certain offset so as to generate banners 126. Job separation pages 116–120 function as banner pages that identify and separate adjacent print jobs 108–114.

Stack 200 of FIG. 5 shows one novel feature in that the physical projection of offset portion 126 forms a barrier that demarcates the boundary between a pair of adjacent print jobs. Therefore, even where no print information is imparted to offset portion 126, just the fact that the job separation pages are offset from the pages of neighboring print jobs which were just delivered will cause the job separation page to act like a divider page even if the job separation page is the same size, weight, color, etc., from the neighboring print jobs being separated. As shown in FIG. 1, stack 200 is delivered into an output tray in a face-down position. Indicia 124 are printed onto offset portions 126 so as to also be delivered in a face-down position (see FIG. 5).

Another novel feature is provided by using an existing document handling device, such as printer 10 of FIGS. 1–3, where more than one input source of paper, or input tray, is provided. For example, color laser printer 10 includes two input paper trays 14 and 15. Different paper can be loaded into input trays 14 and 15, with one tray supplying paper for print jobs and the other tray supplying paper for job separation pages.

Figure 6:
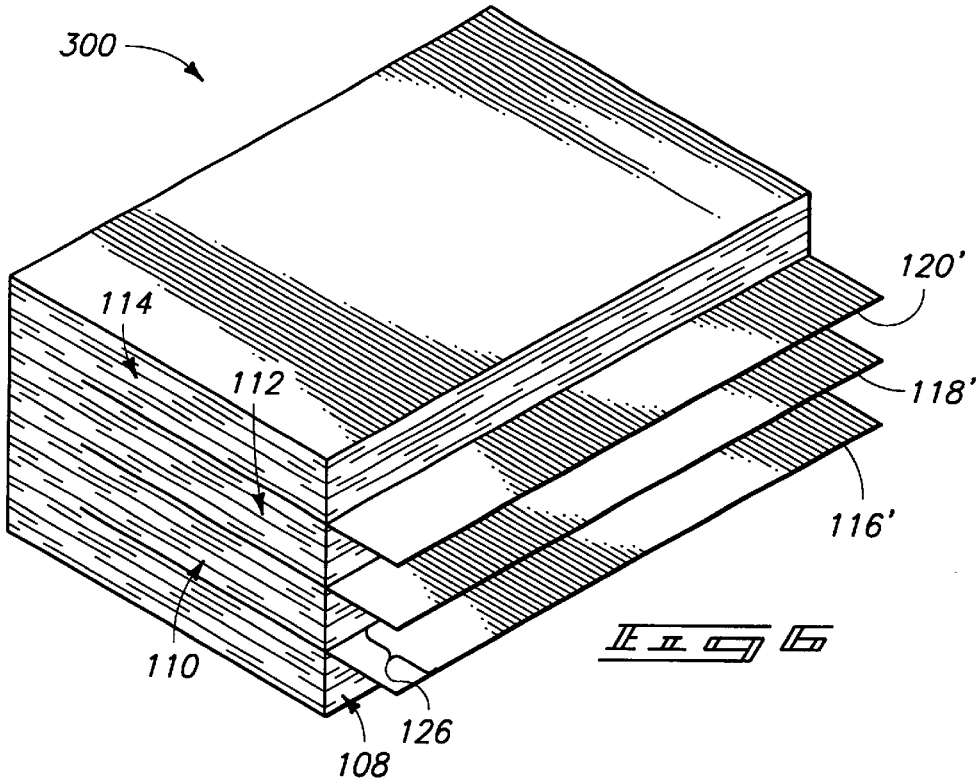
FIG. 6 is a perspective view illustrating a stack of output jobs with each output job being divided from an adjacent output job with an offset banner page that separates the output job from an adjacent output job.

FIG. 6 shows a print job stack 300 including a plurality of print jobs 108–114 which are individually separated by job separation pages 116', 118' and 120'. Job separation pages 116', 118' and 120' do not contain any print information on offset portion 126, or contain any variations in color therebetween.

Another novel variation of Applicant's invention shown in FIG. 6 involves the use of more than one input source of paper. For example, color laser printer 10 of FIGS. 1–3 contains two paper input trays 14 and 15 (see FIG. 1). Different paper can be loaded into each of trays 14 and 15 in order to implement certain novel aspects of Applicant's invention. For example, tray 14 (of FIG. 1) can be loaded with standard letter-size white paper, which is the most commonly used type of paper. In tray 15 (of FIG. 1), a different color of standard letter-size paper can be provided. Such colored paper can be used to form a job separation page, which makes it much easier to distinguish the job separation pages from the rest of the associated print jobs. Hence, a combination of page offset and color variation is provided so as to allow for visual and tactile distinction between neighboring print jobs.

Figure 7:
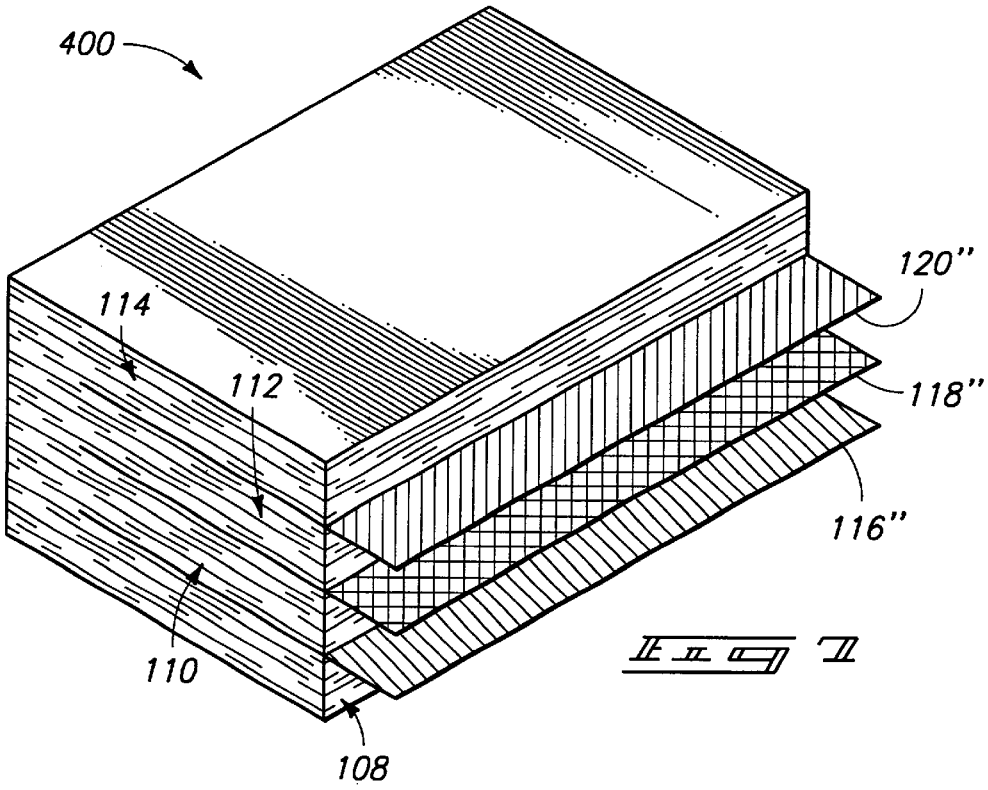
FIG. 7 is a perspective view of a stack of output jobs having offset pages using visually perceptible colored paper as separation pages which are formed from one or more distinguishing colors, and are offset from the adjacent print jobs which they separate.

As shown in FIG. 7, such combination of offset and color variation is depicted wherein print job stack 400 includes print jobs 108–114 which are individually separated by job separation pages 116", 118" and 120". Job separation page 116" comprises a pink sheet of standard letter-size paper, job separation page 118" comprises a yellow sheet of standard letter-size paper, and job separation page 120" comprises a green sheet of standard letter-size paper.

It is understood that the implementation of the techniques of FIG. 7 would require at least two different input trays. One input tray would contain the standard letter-size white paper and the other tray would contain alternating sheets of pink, yellow and green colored sheets of standard letter-size paper. An alternative implementation requires the use of four input paper trays. One paper tray contains white standard letter-size paper. The remaining three trays each contain pink, yellow and green standard letter-size paper, respectively.

Figure 8:
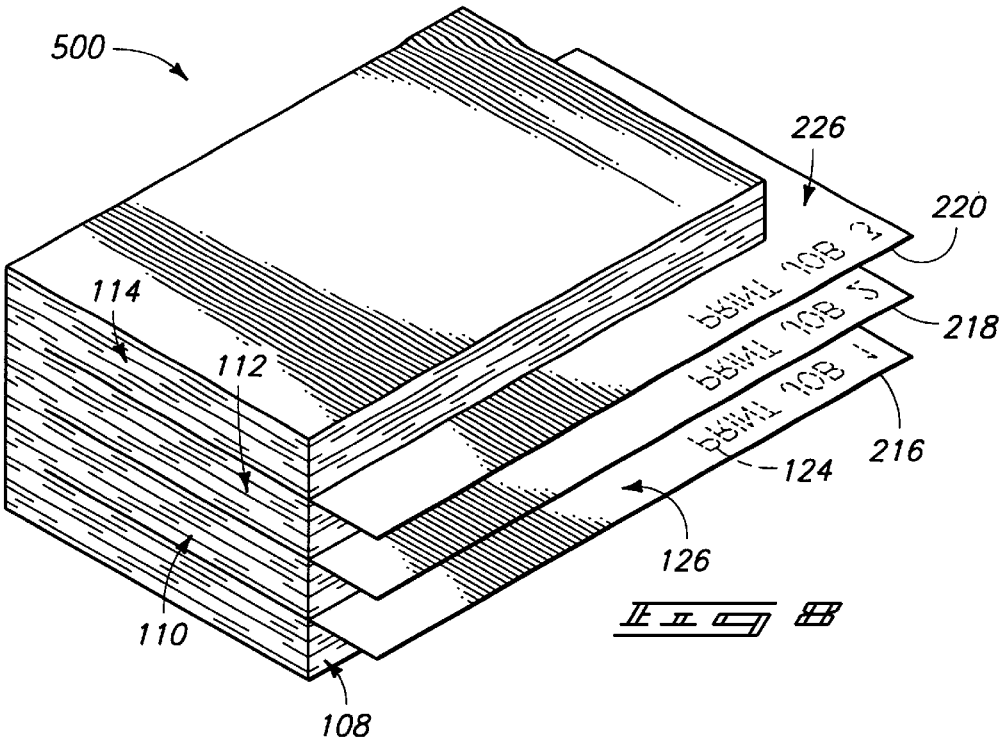
FIG. 8 is a perspective view of a stack of output jobs that are separated by single-sheet banner pages that are formed from different sized sheets of paper which are visually identifiable when placed between adjacent output jobs, and which further include printed visual indicia placed along a banner portion of each offset page.

Yet another novel feature is shown in FIG. 8 which can be implemented by using existing printers and print engines, as shown in FIGS. 1–3, comprises providing more than one input source for paper. For example, a plurality of input paper trays can be provided on a printer. Different paper sizes can be loaded into each input printer tray. The smaller-sized paper present within one of the input trays is used for printing print jobs. The larger-sized paper, or paper having a longer or wider dimension, can be used as the job separation page. The difference in size, or dimension, will enhance the ability to identify by sight or touch the separation point between adjacent print jobs. According to one implementation, such different sized job separation page is also offset from the adjacent print jobs. Optionally, the different sized job separation page is not offset from the print jobs. Hence, even if job offset features are not available on a document handling device, the use of different paper sizes can be used to generate banner pages that separate adjacent jobs.

For example, a print job stack 500 is shown with print jobs 108–114 that are formed from paper that is sized differently from job separation pages 216, 218 and 220. Job separation pages 216–220 are provided between adjacent print jobs so as to separate such print jobs. More particularly, job separation pages 216–220 are formed from sheets of paper that are sized substantially larger than the paper forming print jobs 108–114. Additionally, job separation pages 216–220 are laterally offset with respect to the pages forming print jobs 108–114. The combination of such offset and size difference further enhances the ability to identify by sight and touch the separation point between adjacent print jobs. Such difference in size, in combination with the offset, makes it easier to identify the offset portion on each job separation page. Optionally, job separation pages 216–220 are not offset with respect to the pages forming print jobs 108–114, with the difference in size between job separation pages 216–220 solely providing one or more visible offset portions, or banners, to a user. As shown in FIG. 8, job separation pages 216–220 are sized larger than the pages forming print jobs 108–114 along both vertical and horizontal directions, generating vertical offset portion, or banner, 126 and horizontal offset portion, or banner, 226. Visual indicia 124 are printed on a bottom side of vertical banner 126 in order to identify the print job number of the print job immediately below such respective banner page. Such configuration is suitable for an output tray where output is delivered face down.

Figure 9:
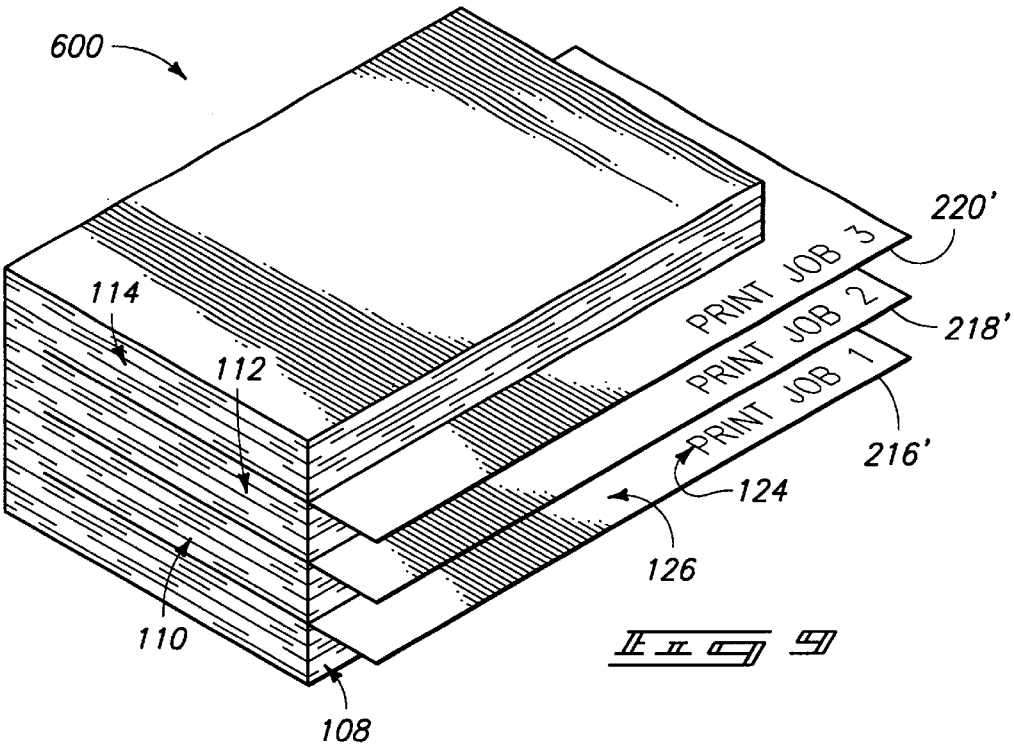
FIG. 9 illustrates a stack of output jobs that are separated by individual offset banner pages that are formed with different paper size, that are printed on a back side to facilitate visual identification by a user retrieving the print jobs from an output tray, and that further include visual indicia placed on a banner portion of the separation pages.

FIG. 9 illustrates an alternative configuration for a print job stack 600 where print jobs are delivered to an output tray in a face-up configuration. More particularly, print job stack 600 is shown with a plurality of print jobs 108–114, and job separation pages 216', 218' and 220'. Visual indicia 124 is printed onto offset portions, or banners, 126 in a face-up manner such that a user can visually identify the indicia, or printed material, provided on the job separation pages.

One form of printed indicia 124 comprises a description of the print job. Another form comprises a description of the user who submitted the print job. Even other indicia 124 comprise bar codes and other identifying visual human and/or machine readable printed media.

As shown in FIG. 9, when delivering print job stack 600 to an output tray of a printer, job separation pages 216', 218' and 220' are delivered with indicia 124 face up, and with print jobs 108–114 face down. In contrast, print job stack 500 was delivered to an output tray such that job separation pages 216', 218' and 220' and print jobs 108–114 were both placed face down. It is understood that indicia 124 can be used to identify either of the neighboring print jobs associated with a specific job separation page. For example, it is possible that job separation page 220 of FIG. 8 is used to identify either print job 112 or print job 114, depending on the manner in which a customer wishes to identify a print job in association with a banner page. In use, users will become accustomed to such implementation and configuration, and will readily identify the print job indicia information 124 with the associated print job whether the page 220 identifies the beginning or end of a neighboring print job.

As another note, when delivering print jobs 108–114 face down into an output tray, as shown in FIG. 8, printed indicia 124 is provided on banner pages 216–220 in a face-down manner to correspond with the face-down presentation of the respective print jobs. Customers will need to take out the jobs from the delivery tray and invert the jobs in order to read such information. However, it is even further possible, where a duplex printing system is provided, to print information on the back side of a banner page such that the information can be read without turning the print job stack 500 and banner pages 216–220 over in order to read such information. Such comprises even another alternative implementation of Applicant's invention which was shown in FIG. 9.

Accordingly, FIG. 9 shows print jobs 108–114 which are delivered face down to an output tray, with banner pages 216', 218' and 220' comprising banner pages that are delivered in a face-down manner, with the back sides of the job separation pages being printed on offset portions, or banners, 126 such that a user can readily identify indicia 124 even without flipping over print job stack 600.

In summary, alternative constructions for input sources, such as standard input trays or high-capacity inputs or multiple input trays, can be utilized with different paper sizes and/or different color media in order to impart visual and/or textual demarcations between adjacent print jobs within a print job stack of a document delivery device. Additionally and/or alternatively, full-bleed printing can be used to impart indicia all the way through an offset portion, or a job separation page. Likewise, offset delivery can be utilized to present an offset portion of a job separation page visibly to a user who is retrieving print jobs from a document delivery device. Even furthermore, duplexing can be utilized to print indicia on the back side of a job separation page, forming a face-up banner, where documents are delivered face down to an output tray of a document delivery device.

Utilization of any of the above methods alone, or in combination, can provide a good and reliable technique for separating output jobs from a document delivery device, such as a printer. An additional advantage is provided in that the combination of features mentioned above is already available on many document handling devices, such as on printers and print engines. However, the techniques described above according Applicant's invention are novel and new and should provide a successful, reliable, and readily identifiable technique for discriminating print jobs within the output trays of document delivery devices.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method for identifying individual output jobs from an output stack, each output job including a stack of one or more individual sheets, comprising:

providing a sheet handling device having a sheet delivery device and an output tray, the sheet delivery device operative to move individual sheets from the sheet handling device to the output tray;

delivering an output job with the sheet delivery device to the output tray; and delivering full-bleed printing indicia onto an offset portion of a job separation page with the sheet delivery device to the output tray, the job separation page stacked adjacent the output job such that the offset portion and the indicia of the job separation page extends outwardly of an adjacent edge of the output job;

wherein the job separation page is operative to identify one end of the adjacent output job.

2. The method of claim 1 wherein the job separation page is stacked in an offset position relative to the output job.

3. The method of claim 1 wherein the job separation page is sized with a dimension larger than a corresponding dimension of the output job.

4. The method of claim 3 wherein the job separation page is also offset from the output job.

5. The method of claim 1 wherein textual indicia are provided on the offset portion of the job separation page.

6. The method of claim 5 wherein the indicia comprises printed job information.

7. The method of claim 1 wherein the indicia comprises a printed user identification.

8. The method of claim 1 wherein the offset portion is formed with a color that visibly contrasts with the print job.

9. The method of claim 1 wherein the job separation page is formed by a sheet of colored paper that contrasts visually with the print job.

10. The method of claim 1 wherein the sheet delivery device comprises a job offset output mechanism configured to deliver the job separation page offset laterally of the print job.

11. A method of separating print jobs, comprising:

providing a printer having an output tray configured to receive a stack of completed print jobs;

delivering a first print job to the output tray;

printing indicia using a full-bleed pigment medium onto an edge of a job separation page;

delivering the print job separation page atop the first print job such that at least one edge of the first print job including the indicia is visibly offset from the first print job; and delivering a second print job atop the print job separation page such that the at least one edge of the print job separation page including the indicia remains visibly offset from the first print job and the second print job so as to visibly separate the first and second print jobs.

12. The method of claim 11 wherein the first print job and the second print job are stacked in alignment one atop the other.

13. The method of claim 12 wherein the print job separation page is interposed between the first print job and the second print job, and is offset from the stacked and aligned first print job and second print job.

14. The method of claim 11 wherein the print job separation page and the first and second print jobs are formed from same sized sheets of paper, and the print job separation page is laterally offset in relation with the first and second print jobs so as to form a projecting offset portion that separates the first and second print jobs.

15. The method of claim 11 wherein an offset portion of the print job separation page comprises a banner including the indicia.

16. The method of claim 11 wherein an offset portion of the print job separation page comprises print job indicia visible from both sides of the print job separation page.

17. The method of claim 11 wherein an offset portion of the print job separation page comprises print job user indicia.

18. A method of separating output jobs, comprising:

providing a document handling device having an output tray configured to receive a stack of output jobs, a first input tray containing a stack of first-sized paper, and a second input tray containing a stack of second-sized paper, the second-sized paper having a planar dimension sized larger than a corresponding dimension of the first-sized paper as stacked in the output tray;

generating a print job with the first-sized paper;

delivering the generated print job to the output tray;

generating a print job comprising indicia using a full-bleed pigment medium onto an edge of a job separation page with the second-sized paper; and stacking the generated job separation page atop the delivered print job such that the larger planar dimension of the job separation page includes the edge and indicia so as to indicate one end of the print job.

19. The method of claim 18 further comprising the step of generating another print job with the first-sized paper and delivering the generated another print job to the output tray so as to stack the generated another print job atop the generated job separation page.

20. The method of claim 18 wherein the step of generating a job separation page comprises retrieving a sheet of the second-sized paper from the second input tray.

* * * * *